US005601417A

United States Patent [19]

Haluda et al.

[11] Patent Number: 5,601,417

[45] Date of Patent: Feb. 11, 1997

[54] HYDRAULIC PUMP WITH BALL BEARING PISTONS

[75] Inventors: Raymond P. Haluda; John J. Hoffman, both of South Bend, Ind.; Charles Lord, Niles, Mich.

[73] Assignee: Ball Bearing Pump, Inc., South Bend, Ind.

[21] Appl. No.: 560,203

[22] Filed: Nov. 21, 1995

[51] Int. Cl.[6] ..... F04B 27/08

[52] U.S. Cl. ..... 417/271; 417/269; 417/273; 92/178

[58] Field of Search ..... 417/269, 271, 417/273; 92/178, 71

[56] References Cited

U.S. PATENT DOCUMENTS

| | | | |
|---|---|---|---|
| 2,251,259 | 8/1941 | Carmichael | 92/178 X |
| 3,592,105 | 7/1971 | Fryklund | 92/172 X |
| 5,304,043 | 4/1994 | Shilling | 417/269 |
| 5,316,446 | 5/1994 | Kimura et al. | 417/269 |
| 5,316,447 | 5/1994 | Fuji et al. | 417/269 |
| 5,317,873 | 6/1994 | Okuda et al. | 417/269 X |

*Primary Examiner*—Richard E. Gluck
*Attorney, Agent, or Firm*—Taylor & Associates, P.C.

[57] ABSTRACT

A hydraulic power unit combining a number of cylinders using ball bearings to displace hydraulic fluid sequentially with controlled flow to a number of hydraulic actuators. A power unit could combine a minimum of two cylinders through ten or twelve cylinders in a practical hydraulic power unit. The inherent bi-directional nature of this combination of fluid displacing ball bearings, cylinder and porting arrangement offers a unique opportunity to change fluid flow by reversing input drive. The torsional reaction component of the opposed reciprocator drives is utilized to rotate the core cylinder assembly to realign outlet and return fluid flow. This realignment can be used to reverse the fluid circuits or redirect the fluid to other work.

12 Claims, 4 Drawing Sheets

HYDRAULIC PUMP WITH BALL BEARING PISTONS

BACKGROUND OF THE INVENTION

1. Field of the Invention

The present invention relates to hydraulic pumps, and, more particularly, to positive displacement hydraulic pumps.

2. Description of the Related Art

The development of successful multi-cylinder axial and radial hydraulic pumps are numerous. The ability to develop high pressures in small lightweight units have made these pump designs ideal for use in the aircraft industry. Pressures in excess of 5000 psi are common. With variable swash plate and radial piston designs (such as used in hydrostatic transmissions), high pressures at zero flow are obtainable. Other applications include refrigeration compressors with cryogenic service.

Conventional axial and radial hydraulic pumps typically include a cylindrical piston which is disposed within a cylinder and connected to a piston rod. Such pumps are used to effect both fluid flow and power transmission. The piston rod either drives or is driven by the cylindrical piston to effect fluid flow or power transmission, respectively. Alternatively, the piston may be generally sphere-shaped and likewise connected to a piston rod. With such sphere-shaped pistons, the piston rod similarly either drives or is driven by the sphere-shaped piston to effect fluid flow or power transmission, respectively.

A recently developed compressor covered by U.S. Pat. No. 5,316,447 to Fuji et al. discloses a movable discharge valve actuated by rising pressure. Another self-reversing hydraulic control for use with a reversing hydraulic pump disclosed by U.S. Pat. No. 4,213,298 to Milgram uses sensors to control direction. A rotary fuel pump with opposed end faces, pistons, return springs, and an adjustable cam plate is taught by Barnard et al. in U.S. Pat. No. 3,216,367. These patents disclose a common theme of utilizing directed fluid to actuate reversing or changing of flow direction.

A problem with conventional axial and radial hydraulic pumps is that they are inherently relatively expensive. The pistons, piston rods, swash plates, pintles, fluid flow passages in the housing, etc. result in a relatively expensive pump which may be overpriced for certain applications.

Conventional hydraulic pumps may also be in the form of continuous flow pumps such as gear pumps. Such pumps typically include an internal gear which is disposed within and eccentric to a ring gear. Rotation of the internal gear and ring gear causes a continuous flow of fluid through the pump. A problem with continuous flow pumps is that a predetermined amount of displaced fluid cannot be accurately achieved.

One possible application for conventional multi-cylinder radial and axial hydraulic pumps is in the recreational vehicle industry to expand travel trailers, motor homes and tent campers by sliding, tipping, or raising portions thereof. However, although such pumps tend to be relatively quiet and reliable, they have not heretofore been cost effective for such applications. Other alternative power sources which have been utilized in an effort to reduce costs include electrically powered screws, hydraulic gear pumps, solenoid valves, double acting cylinders, cable and pulley equalizers, etc.

What is needed in the art is a hydraulic pump which is simple, provides reliable output power, and is relatively low cost.

SUMMARY OF THE INVENTION

According to the present invention, a hydraulic pump includes a pair of ball bearings of different respective diameters which are reciprocally disposed within a cylinder. The reciprocal movement of the ball bearings effect a flow of fluid through the pump.

The invention comprises, in one form thereof, a hydraulic pump including a body having at least one cylinder. At least one pair of ball bearings are respectively disposed within each cylinder, and include a larger diameter ball bearing and a smaller diameter ball bearing. The larger diameter ball bearing and the smaller diameter ball bearing are disposed in abutting relationship to each other and are slidable within the respective cylinder. Each pair of ball bearings is configured to displace a volume of fluid when slid within the respective cylinder.

During the development process, the inventors of the present invention selected hydraulic power as the source of power. However, trying to put together existing hydraulic pumps, valves, and flow control to multiple cylinders proved to be an expensive concept. Initially, a direction was taken to develop a cost effective hydraulic power supply. Pressure requirements for the particular application, i.e., a recreational vehicle application, were low, under 1000 psi. Equal flow to multiple cylinders was also required, but had to be cost effective. Several designs were produced among which was a radial pump using ball bearings. This selection was made to use the ball bearings features of low cost and tolerance control. By combining ball bearings disposed within tubular cylinders having a similar degree of tolerance control, an adequate self sealing pump was produced.

An advantage of the present invention is that the hydraulic pump of the present invention provides reliable output power and fluid control.

Another advantage is that the hydraulic pump of the present invention is simple.

A further advantage is that the hydraulic pump of the present invention is relatively low in cost.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
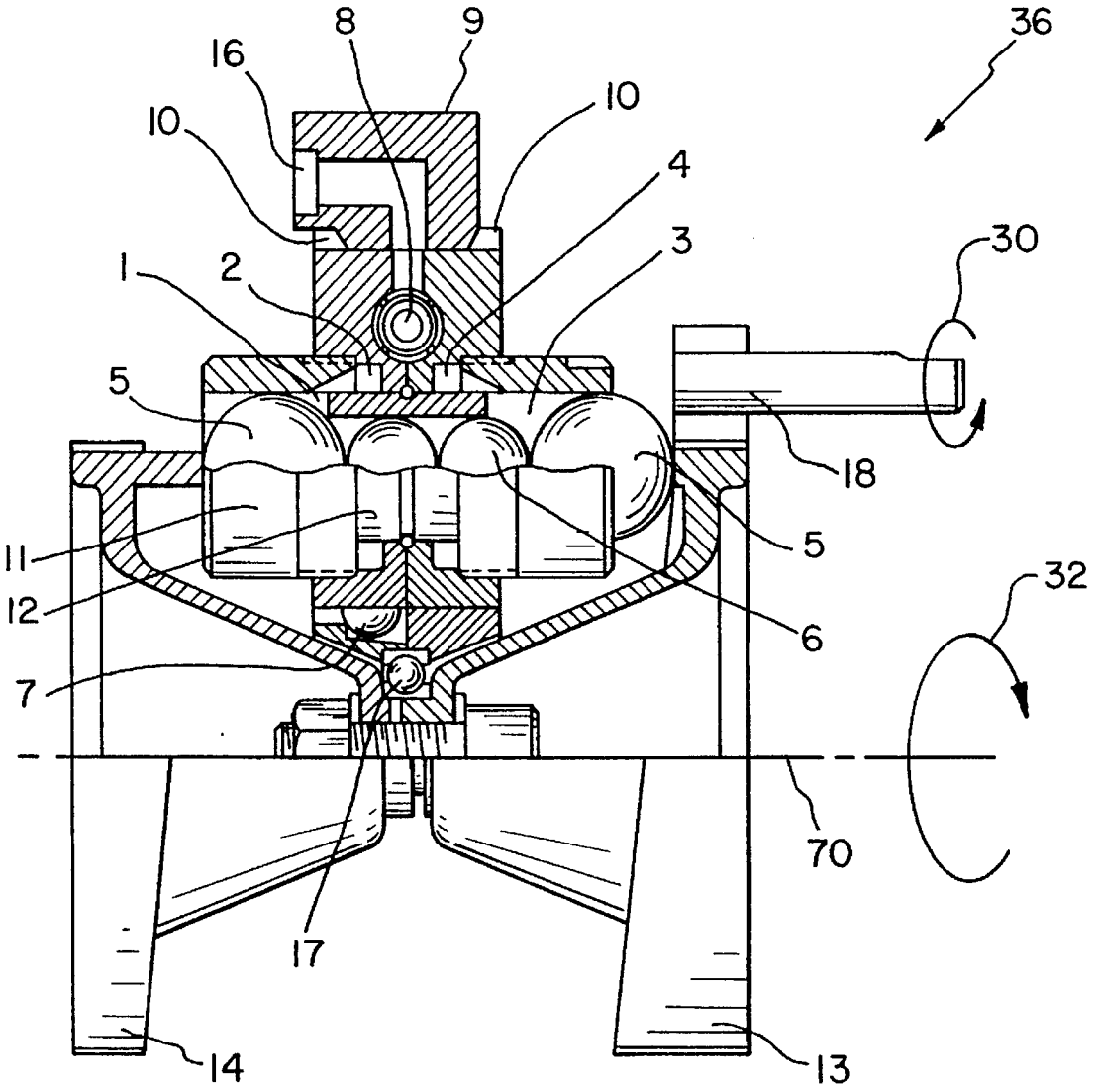
FIG. 1 is a partially sectioned view of one embodiment of a hydraulic pump of the present invention.
Figure 2:
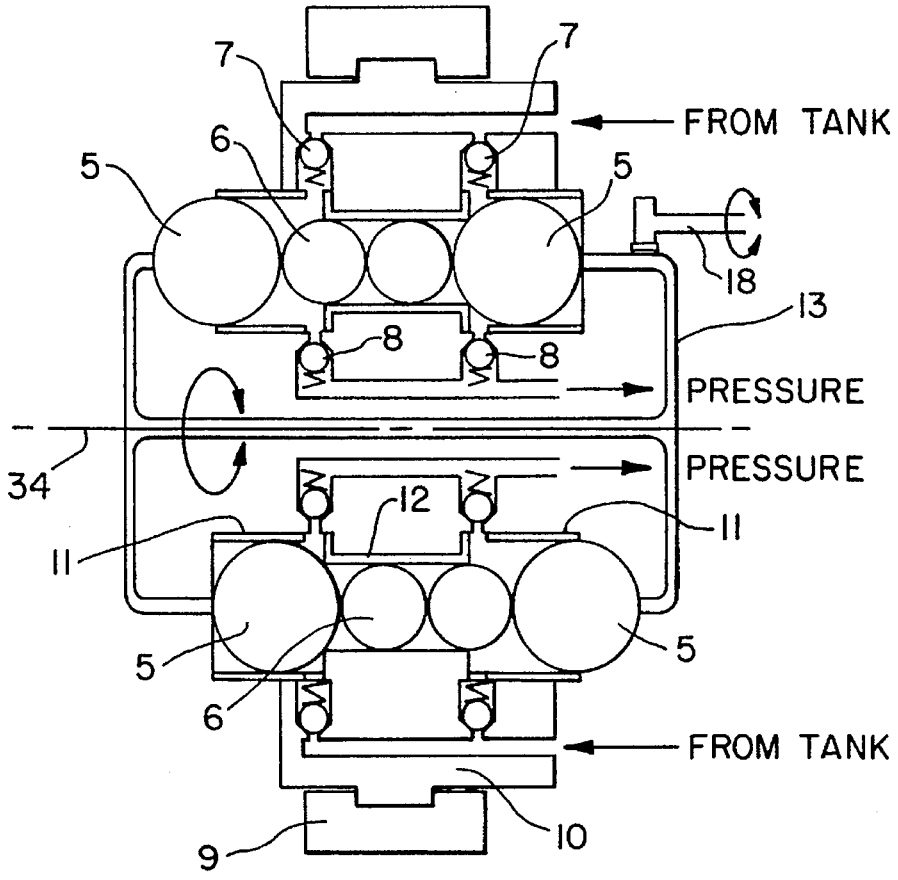
FIG. 2 is a schematic illustration of a fluid circuit corresponding to the pump of FIG. 1.

Referring now to the drawings, FIG. 1 illustrates a partially sectioned view of one embodiment of a hydraulic pump 36 of the present invention, while FIG. 2 illustrates a schematic illustration of a fluid circuit corresponding to hydraulic pump 36 of FIG. 1. Hydraulic pump 36 includes ball bearings 5, 6 which are reciprocally disposed within respective chambers or cylinders 11, 12. The reciprocal movement of ball bearings 5, 6 effects a flow of fluid within pump 36.

Figure 3:
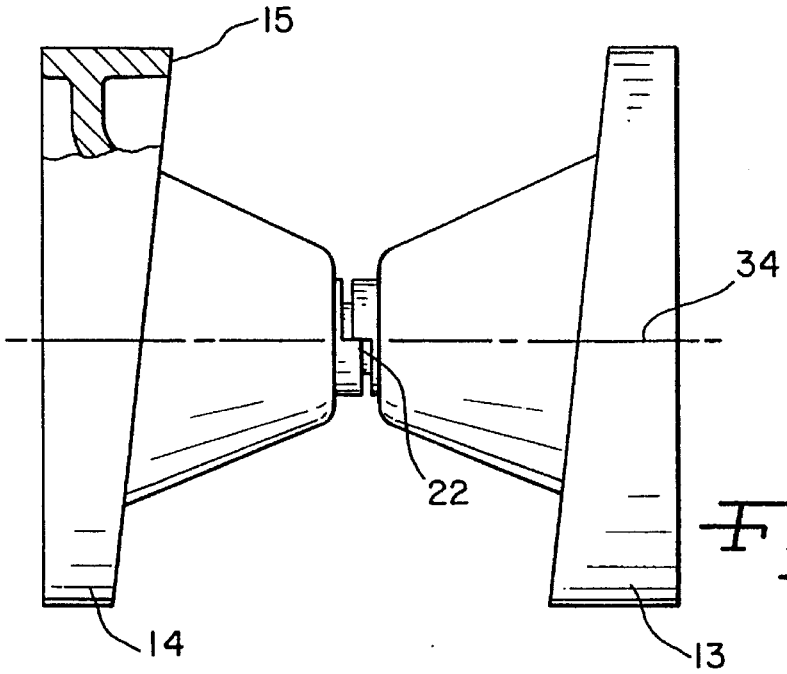
FIG. 3 is a side, partially sectioned view of connected reciprocators.
Figure 4:
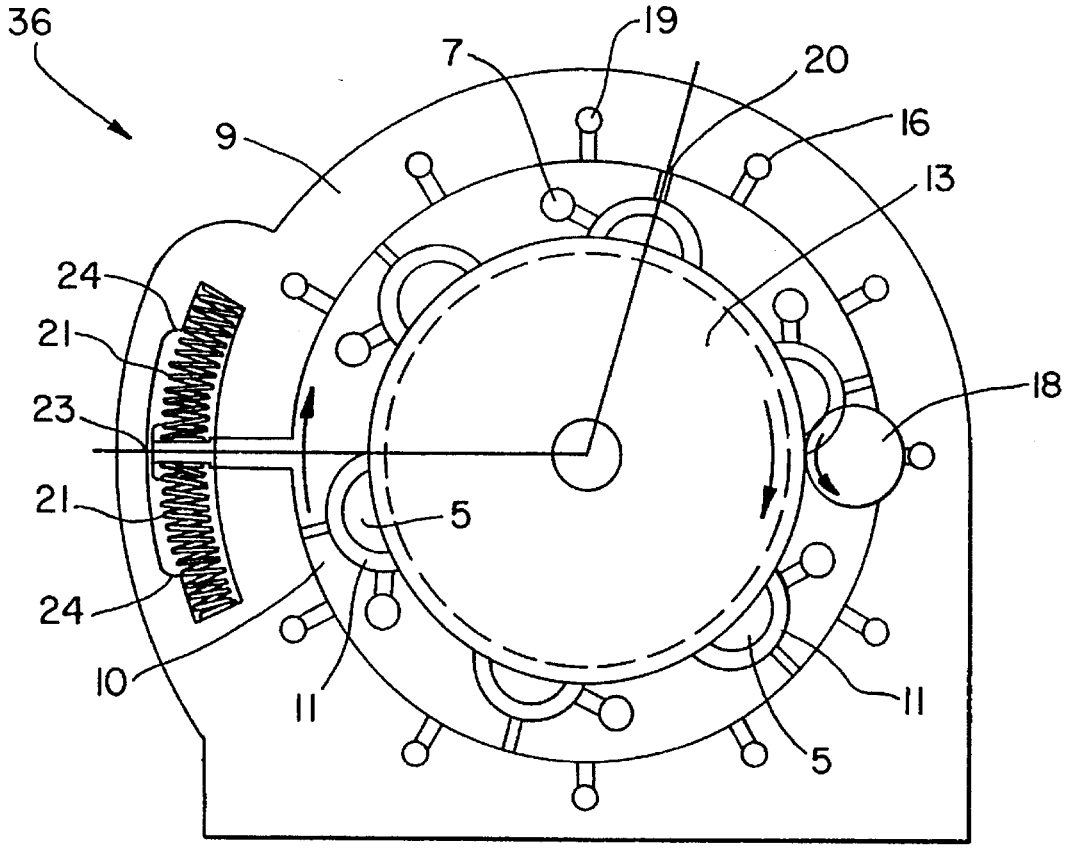
FIG. 4 is a sectional, end view illustrating an embodiment of a neutral, hydraulic lock of the present invention.

More particularly, hydraulic pump 36 includes multiple cylinders 11, 12 in which ball bearings 5, 6 are disposed. A split, mirror image pump body core 10 formed with passage ways 2, 4 and check valve chambers 7, 8 is disposed in close proximity to associated cylinder locations, and adhesive bonded together at assembly. The axially disposed cylinders, e.g., six cylinder units 11, 12 as shown in FIG. 4, are positioned parallel to an axis of revolution 70 of pump 36. A cylinder unit includes three tubular sections 11, 12, 11. The two outer tubular sections 11 are larger than and aligned concentrically with center tubular section 12. By using three segments, tubular sections 11, 12 can be produced to stringent tolerance control at reduced cost. As an added benefit, fluid passages in the form of collector 2 and collector 4 are obtained with a minimum of additional processing because of the interconnection between pump core body 10 and tubular sections 11. Pump ball bearings 5, 6 are located within tubular sections 11, 12. Tubular sections 11, 12 are securely joined together by a press fit, or screw threads or numerous methods familiar to people skilled in the art, and are displaced by the rotation of reciprocator hubs 13, 14. Reciprocator hubs 13, 14 include faces 15 which are phase oriented relative to each other using a step offset 22 at the reciprocator hubs as shown in FIG. 3. Rotation of reciprocator hubs 13, 14 is enhanced by the location of a bearing 17 (FIG. 1), and balanced reciprocator loading (FIG. 2). Reciprocator hubs 13, 14 are rotatably driven using a pinion gear 18 which is enmeshed with hub 13 (FIG. 1), and cause sliding movement of ball bearings 5, 6 within cylinders 11, 12 by imparting an axial force thereto. The terms "slide", "sliding", etc. as used in this application in conjunction with movement of ball bearings means movement of the ball bearings in an axial direction within a cylinder, with or without rotation of the ball bearings.

It will be noted that while FIG. 1 shows inlet check valve 7 on the radially inner side of cylinders 11, 12 and pressure check valve 8 on the radially outer side of cylinders 11, 12, FIG. 2 contrarily shows inlet check valve 7 on the radially outer side of cylinders 11, 12 and pressure check valve 8 on the radially inner side of cylinders 11, 12. It is thus apparent that check valves 7, 8 can be disposed at any number of locations, as long as they are in communication with the interior of cylinders 11, 12.

Referring now to FIG. 4, another feature of the present invention is shown in greater detail. To wit, pump 36 may be configured as a bi-directional pump with pump core body 10 being rotatable to a limited extent between two positions upon rotation of reciprocator hubs 13, 14. Pump core body 10 includes a plurality of channels 20 therein which are disposed in communication with an interior of respective cylinders 11 and either of a first pressure port 16 (also shown in FIG. 1) or a second pressure port 19. Pressure ports 16 and 19 are connected to different fluid lines disposed downstream from pump 36, such that fluid flow may be directed in different directions from pump 36. For example, if pump 36 is connected to a two-way hydraulic cylinder (not shown), then pressure ports 16, 19 can be disposed in communication with opposite ends of the two-way cylinder to provide positive pressure to either end of the ram disposed within the two-way cylinder.

Referring again to FIG. 4, the tangential component of force exerted on ball bearings 5 by rotation of reciprocator hubs 13, 14 causes a rotation of pump core body 10 such that channels 20 are aligned with one of respective pressure ports 16, 19. A core centering projection 23 engages index stops 24 to prevent over-rotation of pump core body 10 such that channel 20 aligns with one of pressure ports 16, 19. Clockwise rotation of reciprocator hubs 13, 14 rotates pump core body 10 (FIGS. 1 and 2) in alignment with pressure port 16, and counter-clockwise rotation of reciprocator hubs 13, 14 rotates pump core body 10 in alignment with pressure port 19. When rotation of reciprocator hubs 13, 14 stops, balance springs 21 return channels 20 of pump core body 10 to a neutral, or hydraulic lock position (shown in FIG. 4) between ports 16 and 19. Balance springs 21 are contained in a recess created between index stops 24 and core centering projection 23.

It is apparent from FIGS. 2 and 4 that pump 36 includes dual-acting, reciprocating ball bearings 5, 6 which are disposed within a plurality of respective cylinders 11, 12 and concentrically spaced about an axis 34 (FIGS. 3 and 4). Ball bearings 5 and 6 are of two diameters, and are sized to produce the required volumetric flow for a particular application. A set of cylindrically opposed reciprocator hubs 13, 14 are positioned concentrically, and are positioned 180 degrees out of phase to drive ball bearings 5, 6. As best seen in FIG. 3, contact faces 15 of reciprocator hubs 13, 14 are disposed at an acute angle relative to the center line of rotation, i.e., axis 34. The perimeter of reciprocator hub 13 (FIG. 1) is geared (not shown) in known fashion to mate with drive pinion 18. The reciprocator hubs 13, 14 are stepped for phase locking at assembly—reciprocator 13 at zero degrees, and reciprocator 14 at 180 degrees. The indexed reciprocator hubs 13, 14 clamp on the inside race of ball bearing assembly 17. Ball bearing assembly 17 is disposed concentric with pump body core 10 which retains the outer race 38 of bearing 17. The molded pump body core 10 is a split, mirror image formed to accept cylinder tubes 11, 12, fluid passages 2, 4, and check valves 7, 8. The perimeter of body core 10 is formed to mate with the outer stationary manifold ring 9 as shown in FIG. 1. Fluid pressure ports 16 and return ports 19 are also molded into outer stationary manifold ring 9, along with index stops 24.

Body core 10 is supported by outer stationary manifold ring 9 and rotates through the angular span between the index stops 24 and the centering projection 23. This rotation changes the flow of fluid from pressure ports 16 to the pressure ports 19, in the outer stationary manifold ring 9. This rotation is caused by the torque reaction of reciprocator hubs 13, 14 driving ball bearings 5, 6. Clockwise rotation of pinion 18 rotates pump body core 10 counterclockwise, and counterclockwise rotation of pinion 18, as indicated by arrow 30, rotates pump body core 10 clockwise, as indicated by arrow 32. Outer manifold ring 9 can be configured for axial or radial deployment of the pressure and return ports. The configuration of the fluid reservoir, i.e., the interior of the hydraulic pump, is designed to contain the pump assembly. When a tubular section reservoir is used in a horizontal mode, the pump assembly can be located at any point; when mounted in a vertical position, the pump is mounted at the bottom of the assembly. Fluid volume requirements determine the size of cylinders 11, 12 required to maintain submergence of all inlet ports 7.

In another embodiment (not shown), fluid ports 16, 19 and a motor mounting can be included as features of the end caps, i.e., reciprocator hubs 13, 14. The fluid reservoir can be formed as deep end caps including fluid ports 16, 19 and the motor mounting. This configuration can be employed for both axial and radial fluid pumps.

Figure 5:
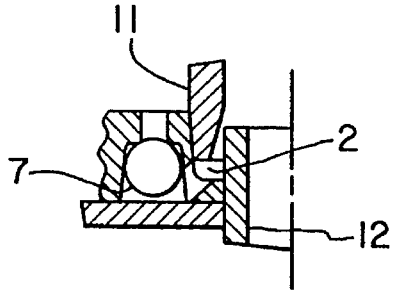
FIG. 5 is a fragmentary, sectional view detailing an embodiment of a check valve used on the inlet side of the pump.
Figure 6:
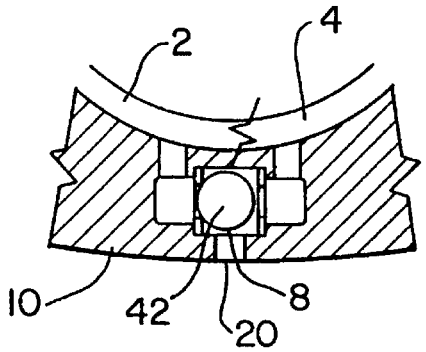
FIG. 6 is a fragmentary, sectional view detailing an embodiment of a check valve used on the pressure side of the pump.

FIGS. 5 and 6 illustrate inlet check valve 7 and pressure check valve 8 (FIGS. 1, 2 and 4) in greater detail. Check valve 7 is shown in fluid communication with and provides one-way fluid flow to annular collector 2. Of course, check valve 7 (or an additional check valve 7, not shown) also is in fluid communication with and provides one-way fluid flow to annular collector 4.

Check valve 8 (FIG. 6) is in fluid communication with and provides one-way fluid flow from annular collectors 2 and 4. Collectors 2 and 4 are shown with a sectional line therebetween for simplicity sake in FIG. 6; however, it is to be understood that collectors 2, 4 are actually disposed parallel to each other as shown in FIG. 1. Check valve 8 is a two-way check valve which alternately effects communication between a pressure port, such as 16, with either one of collectors 2 and 4. The position of ball 42 within check valve 8 is dependent upon the relative pressure differential between chambers 1 and 3 (FIG. 1) within respective cylinders 11.

Figure 7:
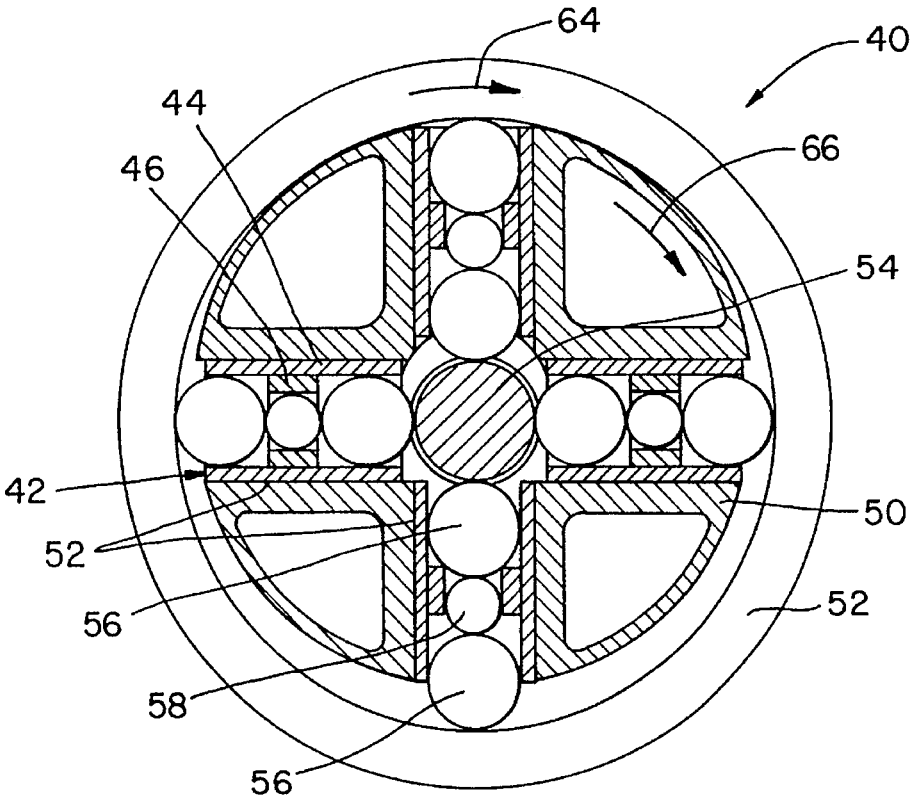
FIG. 7 is an end view of another embodiment of a hydraulic pump of the present invention.
Figure 8:
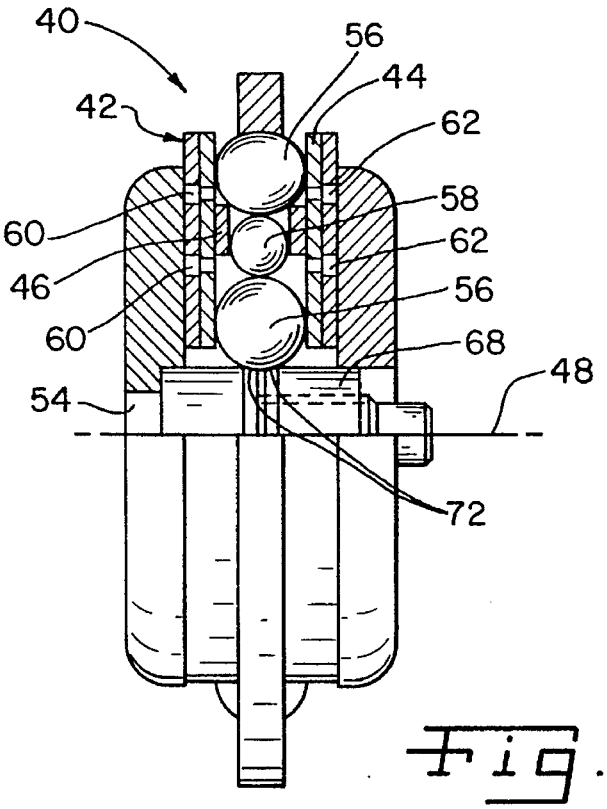
FIG. 8 is a partially sectioned, side view of the pump shown in FIG. 7.

Referring now to FIGS. 7 and 8, another embodiment of a hydraulic pump 40 of the present invention is shown. In contrast with the embodiment of pump 36 shown in FIGS. 1–4, pump 40 is a radial piston design pump. That is, cylinders 42, including tubular sections 44, 46 are disposed in a radial direction relative to the axis of revolution 48 (FIG. 8) of pump 40. Cylinders 42 are formed in a body 50 which rotates about and is disposed concentric with axis 48. An outer race 52 is disposed eccentric to body 50, as shown in FIG. 7. The spacing between the inside diameter of outer race 52 and the outside diameter of a shaft 54 is such that a substantially "zero" clearance exists in a radial direction between each of shaft 54, ball bearings 56, 58 and outer race 52. A sleeve 68 is threadingly coupled with shaft 54 and includes beveled lands 72 for effecting this "zero" clearance condition. The term "zero" clearance, as used herein, means a clearance which is small enough to cause rotation through engagement with an adjacent ball bearing 5 or 6, a clearance which permits lubrication of ball bearings 5, 6 through rotation thereof, and a clearance which does not permit substantial hydraulic fluid leakage.

Ball bearings 56, 58 are disposed and slidable within respective chambers or cylinders 42 including tubular sections 44, 46, and thereby effect a flow of fluid through pump 40. More particularly, referring to FIG. 8, ports or fluid inlets 60 and ports or fluid outlets 62 are disposed in communication with the interior of each cylinder 42. In the embodiment shown, fluid inlets 60 and fluid outlets 62 are each disposed in communication with larger diameter tubular sections 44, and adjacent to smaller diameter tubular section 46. Depending upon the radial orientation of ball bearings 56, 58 within each cylinder 42, the volumetric capacity within tubular sections 44 is enlarged or decreased. This results in a flow of fluid through fluid inlets 60 and fluid outlets 62. Check valves (not shown) are disposed in association with fluid inlets 60 and fluid outlet 62 to effect a one way flow of fluid through pump 40. Of course, it may also be possible to reverse the orientation of the check valves to in turn reverse the functionality of ports 60, 62.

In operation, outer race 52 is driven in a rotational direction as indicated by arrow 64. This in turn causes a rotation of body 50 in a likewise direction, as indicated by arrow 66. Because of the essentially zero clearance between outer race 52 and the radially outward ball bearing 56, outer race 52 also rotates the radially outward ball bearing 56. This causes a resultant counter-rotation of ball bearing 58, and a further resultant counter-rotation of the radially inward ball bearing 56. The radially inward ball bearing 56 in turn rotates about shaft 54. Ball bearings 56, 58 are preferably sized dependent upon the ratio of the circumference of shaft 54 and the circumference at the inside diameter of outer race 52, such that slippage does not occur between ball bearings 56 and 58. This rotating action of ball bearings 56, 58 assists in lubricating ball bearings 56, 58 during the sliding action within the respective cylinders 42. Ball bearings 56, 58 are caused to slidingly reciprocate within and relative to respective cylinders 42 because of the rotation of outer race 52 and eccentric positioning of body 50 relative to outer race 52. The hydraulic fluid within pump 40 is either drawn in or pushed out through fluid inlets 60 and fluid outlets 62, depending upon the orientation of the associated check valves within ports 60, 62.

In the embodiment shown in FIGS. 7 and 8, outer race 52 is driven and shaft 54 remains stationary. However, it is also to be understood that shaft 54 can be driven in a rotational direction and outer race 52 can remain stationary.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic pump, comprising:

a body including at least one chamber, said body further including a fluid inlet and a fluid outlet disposed in fluid communication with each said cylinder;

at least one pair of ball bearings respectively disposed within each said chamber, each said pair of ball bearings including a larger diameter ball bearing and a smaller diameter ball bearing, said larger diameter ball bearing and said smaller diameter ball bearing disposed in abutting relationship to each other and slidable within said respective chamber, each said larger diameter ball bearing and each said smaller diameter ball bearing being disposed in sealing relationship with said respective chamber, each said pair of ball bearings configured to displace a volume of fluid when slid within said respective chamber.

2. The hydraulic pump of claim 1, further comprising a pair of reciprocator hubs disposed on each axial end of each said chamber, said reciprocator hubs effecting said sliding of said ball bearings within said respective chambers.

3. The hydraulic pump of claim 2, wherein said reciprocator hubs also effect a rotating movement of said ball bearings within said respective chambers.

4. The hydraulic pump of claim 1, wherein each said chamber is disposed substantially perpendicular to said axis.

5. The hydraulic pump of claim 4, further comprising an outer race, said body disposed within and eccentric to said outer race, said outer race effecting said sliding of said ball bearings within said respective chambers.

6. The hydraulic pump of claim 5, wherein one of said outer race and said body also effect a rotating movement of said ball bearings within said respective chambers.

7. The hydraulic pump of claim 1, wherein said at least one chamber comprises a plurality of separate chambers.

8. The hydraulic pump of claim 1, wherein said chamber comprises a larger tubular section and a smaller tubular section, said larger diameter ball bearing disposed within said larger tubular section and said smaller diameter ball bearing disposed within said smaller tubular section.

9. The hydraulic pump of claim 1, further comprising at least one additional larger diameter ball bearing respectively disposed within said chamber, said additional larger diameter ball bearing disposed in abutting relationship to said smaller diameter ball bearing and slidable within said respective chamber.

10. The hydraulic pump of claim 1, wherein said pair of ball bearings defines a first pair of ball bearings, and further comprising a second pair of ball bearings respectively disposed within each said chamber, each said second pair of ball bearings including a larger diameter ball bearing and a smaller diameter ball bearing, said larger diameter ball bearing and said smaller diameter ball bearing disposed in abutting relationship to each other and slidable within said respective chamber, said smaller diameter ball bearing of each said first pair of ball bearings disposed in abutting relationship to a respective said smaller diameter ball bearing of each said second pair of ball bearings.

11. The hydraulic pump of claim 1, wherein said body is rotatable to a limited extent between a first position and a second position, said body including at least one channel disposed in communication within an interior of a respective said chamber, each said channel also disposed in communication with one of a first pressure port when said body is in said first position and a second pressure port when said body is in said second position.

12. A hydraulic pump, comprising:

a body including at least one chamber, each said chamber comprising a larger tubular section and a smaller tubular section, said body further including a fluid inlet and a fluid outlet disposed in fluid communication with each said chamber; and at least one pair of smaller diameter ball bearings and at least one pair of larger diameter ball bearings respectively disposed within each said chamber, said larger diameter ball bearings disposed within said larger tubular section and said smaller diameter ball bearings disposed within said smaller tubular section, said smaller diameter ball bearings disposed in abutting relationship to each other and said larger diameter ball bearings disposed in abutting relationship to said smaller diameter ball bearings, each said pair of smaller diameter ball bearings and each said pair of larger diameter ball bearings slidably disposed within said respective chamber, each said pair of smaller diameter ball bearings and each said pair of larger diameter ball bearings disposed in sealing relationship with said respective chamber, said smaller diameter ball bearings and said larger diameter ball bearings configured to displace a volume of fluid when slid within said respective chamber.

* * * * *